US005109145A

United States Patent [19]

Fujita et al.

[11] Patent Number: 5,109,145

[45] Date of Patent: Apr. 28, 1992

[54] VACUUM INTERRUPTER CONTACTS AND PROCESS FOR PRODUCING THE SAME

[75] Inventors: Hajime Fujita, Hachioji; Seishi Chiba; Tsutomu Okutomi, both of Yokohama; Kazuo Suzuki, Tokyo; Masami Idehara, Fuchu; Mitsutaka Honma, Tokorozawa; Seikichi Takashima, Yokohama, all of Japan

[73] Assignee: Kabushiki Kaisha Toshiba, Kawasaki, Japan

[21] Appl. No.: 356,354

[22] Filed: May 25, 1989

[30] Foreign Application Priority Data

May 27, 1988 [JP] Japan ..... 63-129640

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 4,323,590 | 4/1982 | Lipperts | 200/144 BX |
| 4,551,596 | 11/1985 | Watanabe et al. | 200/144 B |
| 4,736,078 | 4/1988 | Yasuoka et al. | 200/144 B |

FOREIGN PATENT DOCUMENTS

| | | |
|---|---|---|
| 0175349A2 | 3/1986 | European Pat. Off. . |
| 2848980 | 5/1980 | Fed. Rep. of Germany . |
| 1-17344 | 1/1989 | Japan . |
| 2056177A | 3/1981 | United Kingdom . |

OTHER PUBLICATIONS

Japan Abstracts, vol. 13, No. 196, E-7551 35441, May 10, 1989 (1-17344, Jan. 20, 1989).

*Primary Examiner*—J. R. Scott

*Attorney, Agent, or Firm*—Foley & Lardner, Schwartz, Jeffrey, Schwaab, Mack, Blumenthal & Evans

[57] ABSTRACT

A vacuum breaker contact produced according to the coating step of forming a metal coated layer comprising at least one metal selected from the group consisting of Cu, Ag, Ni, Sn, In, Fe and alloys thereof on at least a part of the surface of the contact substrate having a predetermined shape to a thickness of 10 μm or less, and the diffusion step of having a part of the metal coated layer diffused into the contact substrate.

20 Claims, 2 Drawing Sheets

VACUUM INTERRUPTER CONTACTS AND PROCESS FOR PRODUCING THE SAME

BACKGROUND OF THE INVENTION

This invention relates to a vacuum interrupter contact comprising a metal coated layer on a contact substrate and a process for producing the same.

FIG. 6 shows a sectional view of a vacuum interrupter (also called as vacuum circuit breaker or vacuum valve). The vacuum interrupter has a substantially cylindrical insulating vessel 20, and a vacuum vessel constituted of end plates 23, 24 made of a metal mounted through sealing fittings 21, 22 at both end faces of the vessel 20. Internally of the vacuum vessel is formed a shielding chamber 25 with a vacuum atmosphere.

Within the shielding chamber 25, there are arranged a first electroconductive rod 26 mounted fixedly extending through the end plate 23, and a second electroconductive rod 27 mounted movably in the axial direction extending through the end plate 24. At the respective opposed ends of these first and second electroconductive rods 26, 27 are mounted a movable electrode 29 having a contact 28 and a movable electrode 31 having a contact 30 so as to be opposed to each other.

Between the second electroconductive rod 27 and the end plate 24, there is mounted a bellows 34 for maintaining air tightness. Outside of the bellows is mounted a bellows cover 35 for protecting the bellows 34 from the arc vapor generated between both contacts 28, 30. Further, internally of the vacuum vessel, there is provided an arc shield 36 for protecting the insulating vessel 20 from the arc vapor. The vacuum interrupter is adapted to be opened and closed according to a driving mechanism (not shown) through the electroconductive rod 27.

Next a description is provided by referring to FIG. 7. On the electroconductive rod 27, a movable electrode 31 is mounted by a soldering portion 32. On the movable electrode 31 is mounted a contact through the soldering portion 33. The contact 30, after having been worked into a predetermined shape, is assembled into the shielding chamber soldered onto the electrode or the electroconductive rod. If necessary, a conditioning treatment is applied to clean and finish the surface. Also, as similar materials for contact, alloys such as Cu-Bi type, Cu-Te type, Cu-W type, Cu-WC type, Cu-Cr type, Cu-Ti type, etc. may be used depending on the intended.

It is demanded for this kind of vacuum interrupter contact that its surface should not be contaminated with oxide coating, etc. However, the contact material has the problem that surface oxidation proceeds in the course from working to assembling in the vacuum interrupter. Besides, depending on the management situation during that time, there are the following problems in that the state of contamination is not constant and the quality is not stabilized.

First, such contamination cannot be removed easily even by conditioning treatment, and therefore there is the problem that the contact resistance characteristics becomes unstable.

To cope with this problem, the practice has been to attach a metal coating such as Cu onto the surface of the contact substrate, thereby alleviating any influence from atmosphere. In the case of this countermeasure, for stabilizing contact resistance, the metal coating is required to be formed sufficiently thick. However, if it is too thick, not only lowering in welding resistance as the contact is brought about, but also the adhesion strength between the coating and the contact substrate is weakened to give rise to peeling, whereby there is also a problem that lowering in dielectric strength characteristics may be brought about.

In the case where the cause for of making the contact resistance higher resides in formation of an oxide coating of an active metal such as Al, Ti, Cr, etc., it may be considered to remove mechanically the oxide coating by blasting of rigid particles. However, in this case, the blasted rigid particles may penetrate into the matrix to remain there, and also the surface roughening proceeeds, whereby there is the problem that no necessarily satisfactory value in dielectric strength characteristics can be obtained. Also, for a thermally stable coating such as on oxide of Al, Ti or Cr, time and expenses are consuming for carrying out reduction with hydrogen or voltage-current conditioning treatment which is inconvenient without obtaining sufficient effects in many cases.

The next problem is that, when the vacuum interrupter contact is generally solder bonded to an electrode in a hydrogen reducing atmosphere, or nitrogen or vacuum atmosphere, the strength of the solder bonded portion is affected by contamination of the oxide coating of the vacuum interrupter contact, and depending on the state of such contamination, the strength at the solder bonded portion may become extremely weak. In the contact material containing an active metal such as Al, Ti or Cr, there is the problem that formation of an oxide coating exerts an influence on the strength of the solder bonded portion.

SUMMARY OF THE INVENTION

Accordingly, an object of the present invention is to cancel the problems possessed by the prior art as described above and provide a vacuum interrupter contact having great strength at the solder bonded portion and a process for producing the same.

The vacuum interrupter contact according to the present invention has a metal coated layer comprising at least one metal selected from the group consisting of Cu, Ag, Ni, Sn, In, Fe and alloys thereof and having a thickness of 10 μm or less formed on at least a part of the surface of a contact substrate having a predetermined shape.

According to a preferred embodiment of the present invention, a part of the above metal coated layer is diffused in at least a part of the contact substrate.

Further, the process for preparing the vacuum interrupter contact of the present invention comprises the coating step of forming a metal coated layer comprising at least one metal selected from the group consisting of Cu, Ag, Ni, Sn, In, Fe, and alloys thereof on at least a part of the surface of a contact substrate having a predetermined shape to a thickness of 10 μm or less, and the diffusion step of having a part of the metal coated layer diffused into said contact substrate.

DETAILED DESCRIPTION OF THE INVENTION

The surface of the vacuum interrupter contact is subjected to contamination from atmosphere. Even if the time from contact working to breaker assembling may be shortened, there is a limit in prevention of contamination. According to the present invention, a metal coated layer is formed on the contact substrate, and at the interface between the contact substrate and the metal coated layer, the metal coated layer is adapted to be diffused to a predetermined thickness into the contact substrate. In this case, by making the metal coated layer at the undiffused portion existing on the contact substrate to 10 μm or less, the contact itself can be made to have excellent welding characteristics. Moreover, even if it is subjected to mechanical or thermal impact during opening or closing of the contact or during shielding actuation, since the change is adapted to occur as associated with the change received by the contact, there will not occur peel-off because of the diffusion effect in the above diffusion region.

In the following, referring to the accompanying drawings, specific embodiments of the vacuum interrupter contact and the process for producing the present invention are described.

Figure 1:
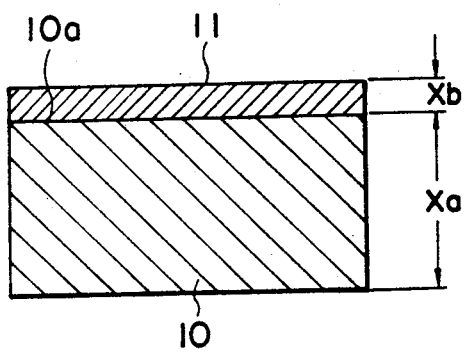
FIG. 1 is a longitudinal sectional view showing the state before the diffusion step of the vacuum interrupter contact of the present invention.

First, the step of forming a metal coated layer on the contact surface side of the contact substrate is described. The coating step, as shown in FIG. 1, prepares a contact substrate 10 having a thickness Xa, and forms a contact surface side metal coated layer 11 for contamination prevention having a thickness Xb on the contact surface 10*a* of the contact substrate 10 according to the ion plating method.

Here, as the contact substrate 10, for example, alloys of Cu-Bi type, Cu-Te type, Cu-W type, Cu-WC type, Ag-W type, Ag-WC type, Cu-Cr type, Cu-Ti type, etc., may be used variously depending on the purpose. Also, as the contact surface side metal coated layer 11, at least one metal selected from among Cu, Ag, Ni, Sn, In and Fe or alloys of these can be used.

Figure 2:
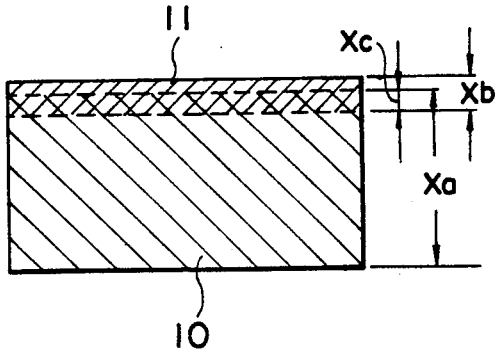
FIG. 2 is a longitudinal sectional view showing the state after the diffusion step of the vacuum interrupter contact of the present invention.

Next, in the diffusion step, as shown in FIG. 2, the contact surface side metal coating layer 11 formed is diffused on the contact surface 10*a* of the contact substrate 10. As the ways to be used for such diffusion, there are (1) diffusion as a separate step after completion of the coating step, (2) simultaneous diffusion in the vicinity of the interface during progress of the coating step, (3) diffusion with heating during soldering of the contact substrate 10 having the contact surface side metal coated layer 11 to the electrode, (4) diffusion of the both cases of (1) and (2) as mixed together, etc. In the diffusion step, diffusion from the contact substrate 10 to the contact surface metal coated layer 11 is also effected at the same time.

The diffusion depth Xc is required to be at least 20% of the initial thickness Xb of the contact surface side metal coated layer 11. This is because, with less than 20%, the adhesion strength with the contact substrate 10 becomes weaker, whereby the contact surface side metal coated layer 11 is peeled off to give rise to variance in contact resistance value. Also, the thickness Xb-Xc of the metal coated layer remaining at the undiffused portion, namely at the portion near the contact surface, is required to be 10 μm or less, preferably 5 μm or less. This is because, if the residual metal coated layer thickness Xb-Xc exceeds 10 μm, welding resistance becomes to be lowered.

For forming the contact surface side metal coated layer 11 on the above contact substrate 10, it is preferable to use the ion plating method. The electrochemical plating method of the prior art is not desirable, because corrosion with a plating solution occurs on the contact, and the vacuum deposition method is not desirable because of weak adhesion strength. According to the ion plating method, these disadvantages can be sufficiently cancelled, and can provide the highest class of vacuum interrupter contact.

Table 1 shows evaluation of the contact resistance characteristics and welding charaeteristics of the vacuum interrupter contacts for experiments by use of Cu-50Cr type alloys. In the Table Rc shows contact resistance.

TABLE 1

| | Contact substrate (wt %) | | Contact surface side metal coated layer (μm) Material | Thickness Xb | Diffusion thickness to contact Xc | Xb-Xc | Ratio of diffusion depth Xc into contact to initial thickness Xb Ratio of Xc to Xb | Contact resistance Ratio of 100 μΩ or less (%) | Ratio of 100 μΩ or more (%) | Welding characteristic Welding withdrawing force (kg) | Remarks |
|---|---|---|---|---|---|---|---|---|---|---|---|
| Comparative Example 1 | Cu—Cr | (50) | Cu | 2.5 | 0 | 2.5 | 0 | 94 | 6 | 10~30 | Rc: great |
| Example 1 | Cu—Cr | (50) | Cu | 2.5 | 0.5 | 2 | 20 | 100 | 0 | 20~60 | |
| Comparative Example 2 | Cu—Cr | (50) | Cu | 22 | 7 | 15 | 32 | 93 | 7 | 80~250 | |
| Example 2 | Cu—Cr | (50) | Cu | 10 | 5 | 5 | 50 | 100 | 0 | 20~60 | |
| Example 3 | Cu—Cr | (50) | Cu | 6 | 4.5 | 1.5 | 75 | 100 | 0 | 20~60 | |
| Example 4 | Cu—Cr | (50) | Cu | 6 | 6 | 0 | 100 | 100 | 0 | 20~60 | |
| Comparative Example 3 | Cu—Cr | (50) | Ag | 10 | 0 | 10 | 0 | 92 | 8 | 40~100 | Rc: great variance |
| Example 5 | Cu—Cr | (50) | Ag | 8 | 5 | 3 | 63 | 100 | 0 | 10~40 | |
| Example 6 | Cu—Cr | (50) | Ni | 7 | 3 | 4 | 30 | 100 | 0 | 10~30 | |
| Example 7 | Cu—Cr | (50) | Sn | 8 | 6 | 2 | 75 | 100 | 0 | 10~30 | |
| Example 8 | Cu—Cr | (50) | In | 8 | 8 | 0 | 100 | 100 | 0 | 10~30 | |
| Example 9 | Cu—Bi | (1) | Ni | 5 | 2 | 3 | 40 | 100 | 0 | 0~10 | |

TABLE 1-continued

| | Contact substrate (wt %) | | Contact surface side metal coated layer (μm) Material | Thickness Xb | Diffusion thickness to contact Xc | Xb-Xc | Ratio of diffusion depth Xc into contact to initial thickness Xb Ratio of Xc to Xb | Contact resistance Ratio of 100 μΩ or less (%) | Ratio of 100 μΩ or more (%) | Welding characteristic Welding withdrawing force (kg) | Remarks |
|---|---|---|---|---|---|---|---|---|---|---|---|
| Example 10 | Cu—Pb | (2) | Ni | 5 | 2 | 3 | 40 | 100 | 0 | 0~10 | |
| Example 11 | Cu—Te | (4) | Ni | 5 | 1 | 4 | 20 | 100 | 0 | 0~10 | |
| Example 12 | Cu—Sb | (1) | Ni | 5 | 3 | 2 | 60 | 100 | 0 | 0~10 | |
| Comparative Example 4 | Cu—Te | (1) | None | — | — | — | — | 95 | 5 | 0~10 | |
| Example 13 | Cu—W | (30) | Cu | 5 | 2.5 | 2.5 | 50 | 100 | 0 | 20~50 | |
| | —Sb | (0.2) | | | | | | 100 | 0 | 20~50 | |
| Example 14 | Cu—Mo | (30) | Cu | 8 | 4 | 4 | 50 | 100 | 0 | 20~50 | |
| Example 15 | Cu—Ti | (30) | Cu | 7.5 | 5 | 2.5 | 67 | 100 | 0 | 20~50 | |
| Example 16 | Ag—WC | (38) | Ag | 6 | 5 | 1 | 83 | 100 | 0 | 20~50 | |
| | —Co | (3) | | | | | | 100 | 0 | 20~50 | |
| Example 17 | Cu—MoC | (30) | Cu | 10 | 6 | 4 | 60 | 100 | 0 | 20~50 | |
| Example 18 | Cu—TiC | (30) | Cu | 6 | 2 | 4 | 33 | 100 | 0 | 20~50 | |
| Example 19 | Cu—$Cr_3C_2$ | (30) | Cu | 6 | 3 | 4 | 50 | 100 | 0 | 20~50 | |
| Comparative Example 5 | Cu—Ti | (30) | None | — | — | — | — | 91 | 9 | 20~40 | |
| Comparative Example 6 | Cu—TiC | (30) | None | — | — | — | — | 97 | 3 | 10~30 | |
| Comparative Example 7 | Cu—Cr | (50) | None | — | — | — | — | 93 | 7 | 10~30 | |
| Comparative Example 8 | Cu—Cr | (50) | *1 | 5 | — | — | — | 90 | 10 | 20~60 | *1 Vacuum depositon |
| Comparative Example 9 | Cu—Cr | (50) | *2 | 3 | — | — | — | 88 | 12 | 10~30 | *2 Electroplating |

In Table 1, comparison is made between the case where Cu was coated respectively on the contact surface of the contact substrate 10 and the bonded surface on the opposite side by means of an ion plating device (Examples 1–4, Comparative Examples 1–2), the case where Ag was coated (Example 5, Comparative Example 3), the case where Ni was coated (Example 6), the case where Sn was coated (Example 7), the case where In was coated (Example 8), on the contact surface of the contact substrate 10 and the bonded surface on the opposite side by means of an ion plating device, and further the case where nothing is coated on the contact surface of the contact substrate 10 and the bonded surface on the opposite side (Comparative Example 7).

Here, ion plating is conducted by applying a voltage of 2000 V under a vacuum degree of $4\times10^{-5}$ mmHg after heating the contact substrate 10 under evacuation of $10^{-5}$ mmHg as the pretreatment. The thickness Xb of the contact surface side metal coating layer 11 is measured by use of other test strips not used for various tests as described above by using a film thickness meter and an ion microanalyzer in combination. Further, the diffusion depth Xc into the contact substrate 10 is measured by microscopic observation of the test strip cross-section and X-ray microanalyzer. Further, diffusion into the contact substrate 10 during ion plating has been known to proceed in the vicinity of the interface, and also in the process of the soldering treatment between the contact and the electrode, and therefore the above diffusion depth Xc is measured after giving the soldering treatment.

The contact applied with the metal coated layer 11 is assembled in an insulating vessel of a vacuum interrupter, and after the insulating vessel is made a vacuum degree of $10^{-7}$ mmHg, it is heated to 600° C. to apply the baking treatment, followed further by application of a voltage of about 80 KV to effect the conditioning treatment. The contact resistance and the welding force of the vacuum interrupter contact thus obtained are shown in Table 1.

Here, the contact resistance is measured for 10 vacuum interrupters by passing current of DC 10A after contacting 10 sites for each breaker with the electrode contact under a contact load of 20 kg. The contact resistance is shown in terms of the ratio of the contact resistance value of less than 100 μΩ to that of 100 μΩ. The welding force is measured in terms of the withdrawing force of the contact after welding of the electrode contact under the conditions of a contact load of 50 kg, a current passage of 40 KA and a current passage time of 10 ms.

As is also apparent from Table 1, it can be understood that with a thickness Xb-Xc of the metal coated layer 11 remaining on the contact surface side of the contact of 5 μm or less, e.g., Examples 1 –4, the contact resistance is stabilized as less than 100 μΩ, but in the case of a thickness of 5 μm or more, e.g., Comparative Example 2, the contact resistance may become 100 μΩ or higher to result in unstability. This is because cracks or collapses appear on the metal coated layer 11 as the result of impact by opening and closing actuations of the contact, where foreign matter may be progressed or attached, or contact constitutent material elements other than the coated metal may migrate from the base to the surface, thereby increasing the contact resistance. Even when the thickness Xb-Xc of the remaining metal coated layer 11 may be within a preferable range, if there is no diffusion between the metal coated layer and the contact substrate, and yet there is a problem in strength (e.g. Comparative Example 1), it can be understood that the contact resistance becomes unstable by exposure of the contact substrate due to peel-off or drop-off of the metal coated layer from the contact substrate.

As is apparent from the above descriptions, by making the thickness Xb-Xc of the metal coated layer 11 remaining on the contact surface side of the contact 5 μm or less, and yet the ratio of the diffusion depth Xc to the metal coated layer thickness Xb 20% or higher, a vacuum interrupter having stable contact resistance can be obtained.

This is also the same where the material constituting the metal coated layer 11 is made of Ag. That is, in the case of a thickness of Xb-Xc of the metal coated layer 11 of 10 μm (e.g. Comparative Example 3), variance is seen unfavorably in contact resistance, but in the case where the thickness Xb-Xc of the metal coated layer 11 is 3 μm and yet the ratio of the diffusion depth Xc to the metal coated layer thickness Xb is 63% (e.g. Example 5), it can be understood that the contact resistance is stable.

Also, it can be understood that the thickness Xb-Xc has also an influence on welding characteristics. For example, when the thickness Xb-Xc is as thick as 15 mm (e.g. Comparative Example 2), the welding withdrawing force can be understood to be high and yet large in the amount of variance. This fact is evident when compared with the case of the Cu-Cr type contact without a metal coated layer (e.g. Comparative Example 7).

Further, it can be understood that peeling of the metal coated layer 11 can easily occur when the metal coated layer is formed by the vacuum vapor deposition method or the electroplating method (e.g. Comparative Examples 8–9). With this fact, superiority of the ion plating method can be understood.

The effect and the tendency as described above are the same even when the contact material may be the Cu-Bi type, the Cu-Pb type, the Cu-Te type, the Cu-Sb type (e.g. Examples 9–12), and this fact is evident also when compared with the case of the Cu-Te type without the metal coated layer (e.g. Comparative Example 4). Also, the above effect and the above tendency are the same with other contact materials, the Cu-W-Sb type, the Cu-Mo type, the Cu-Ti type, the Ag-WC-Co type, the Cu-MoC type, the Cu-TiC type, the Cu-$Cr_3C_2$ type (e.g. Examples 13–19), and this fact is evident also when compared with the case of the Cu-Ti, Cu-TiC, Cu-Cr type contact without the metal coated layer (e.g. Comparative Examples 5–7).

Further, as the material for the contact substrate 10, Cu is not limitative but Ag may be employed. When Ag is used as the material for the contact substrate (e.g. Example 16), the above effect and the above tendency can be also obtained.

Figure 3:
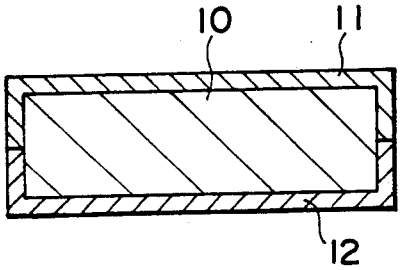
FIG. 3 and FIG. 4 are each longitudinal sectional views showing the vacuum interrupter contact of the present invention.

Next, the step of forming a metal coated layer on the contact surface side of the contact substrate is described. The coating step, as shown in FIG. 3, prepares a contact substrate 10 and forms a bonded surface side metal coating layer 12 on the soldering bonded surface such as an electrode according to the ion plating method. Here, as the contact substrate 10, other than the Cu-Cr system, the Cu-Ti system, contact materials including active metals such as Cr, Ti, Al, etc. may be variously employed suitably depending on the purpose. As the bonded surface side metal coated layer 12, at least one metal selected from among Cu, Ag and Ni may be employed.

Figure 4:
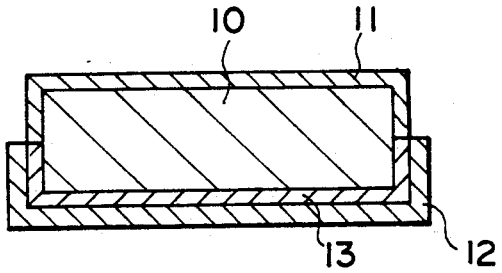

Also, as shown in FIG. 4, a contact substrate 10 is prepared, and a bonded surface side metal coated layer 12 is formed according to the ion plating method on the soldering bonded surface side such as the electrode. Here, as the contact substrate 10, in addition to the contact materials, materials such as the Cu-Bi type, the Cu-Te type, the Cu-W type, the Cu-WC type, the Ag-W type, or the Ag-WC type are used variously suitably corresponding to the purpose. As the barrier layer 13, Fe, Ni or both metals may be employed, and as the bonded surface side metal coated layer, at least one metal selected from among Cu, Ag and Ni may be employed.

When the contact thus formed is bonded to an electrode by silver soldering, the metal coated layer 12 or the barrier layer 13 is diffused into the contact substrate 10.

For formation of the bonded surface side metal coated layer 12 or the barrier layer 13 on the above contact substrate 10, it is preferable to use the ion plating method. The reason is the same as explained in the case of forming the contact surface side metal coated layer 11.

In Tables 2–3, vacuum interrupter contacts for experiments were formed by use of Cu-50Cr, and the results of evaluation of the tensile strength at the silver soldered portion of the contacts are shown.

TABLE 2

| | Contact substrate (wt %) | Bonded surface side metal coated layer | | Tensile strength ($kgf/mm^2$) |
|---|---|---|---|---|
| | | Material | Thickness (μm) | |
| Comparative Example 10 | Cu—Cr (50) | None | — | 2.2~3.8 |
| Example 20 | Cu—Cr (50) | Cu | 1 | 10.8~12.1 |
| Example 21 | Cu—Cr (50) | Cu | 2 | 9.3~12.4 |
| Example 22 | Cu—Cr (50) | Cu | 5 | 11.2~14.3 |
| Example 23 | Cu—Cr (50) | Cu | 10 | 11.5~14.9 |
| Example 24 | Cu—Cr (50) | Ni | 2 | 10.8~14.0 |
| Example 25 | Cu—Cr (50) | Ni | 4 | 9.8~12.5 |
| Example 26 | Cu—Cr (50) | Ni | 7 | 10.1~13.6 |
| Example 27 | Cu—Cr (50) | Ni | 10 | 10.5~14.0 |

TABLE 3

| | Contact substrate (wt %) | Barrier layer | | Bonded surface side metal coated layer | | Tensile strength ($kgf/mm^2$) |
|---|---|---|---|---|---|---|
| | | Material | Thickness (μm) | Material | Thickness (μm) | |
| Example 28 | Cu—Cr (50) | Ni | 1 | Cu | 1 | 9.9~12.5 |
| Example 29 | Cu—Cr (50) | Ni | 2 | Cu | 2 | 11.3~13.8 |
| Example 30 | Cu—Cr (50) | Ni | 4 | Cu | 5 | 10.5~13.3 |
| Example 31 | Cu—Cr (50) | Ni | 8 | Cu | 10 | 12.6~14.1 |
| Example 32 | Cu—Cr (50) | Ni | 4 | Ag | 5 | 13.3~13.6 |
| Example 33 | Cu—Cr (50) | Fe | 4 | Cu | 4 | 10.9~14.4 |
| Example 34 | Cu—Cr (50) | Fe | 4 | Ag | 5 | 12.3~13.5 |
| Example 35 | Cu—Cr (50) | Fe + Ni | 7 | Cu | 5 | 13.1~14.9 |

In Tables 2–3, comparison is made between the case when Cu was coated on the bonded surface of the contact substrate 10 by means of an ion plating device (Examples 20–23), the case where Ni was coated (Examples 24–27), the case where Ni was coated as the barrier layer 13 (Examples 28–32), the case where Fe was coated, the case where a mixture of each 50% of Fe and Ni was coated (Example 35), and further the case where nothing was coated on the bonded surface of the contact substrate 10 (Comparative Example 10).

Here, ion plating is conducted by applying a voltage of 2000 V under a vacuum degree of $4 \times 10^{-5}$ mmHg after heating the contact substrate 10 under evacuation of $10^{-5}$ mmHg as the pretreatment. The thicknesses of the bonded surface side metal coated layer 12 and the barrier layer 13 were measured by use of other test strips not used for various tests as described above, using a film thickness meter and an ion microanalyzer in combination, and also measured by microscopic observation of the test strip cross-section and an X-ray microanalyzer. Measurement of the thickness is performed before the silver soldering treatment.

The vacuum interrupter contact thus obtained was solder bonded by use of Cu and Ag based soldering materials for bonding in a hydrogen reducing atmosphere to assemble a test piece for evaluation of tensile strength. Also, for comparison, the contact substrate without the metal coated layer was similarly assembled. The number of samples provided was 20 for each case, and the test pieces were applied to a tensile tester.

As is also apparent from Tables 2–3, in absence of the metal coated layer (Comparative Example 10), the tensile strength was found to be 2.2–3.8 kg/mm$^2$, indicating breaking from the solder bonded portion. In contrast, according to the present Examples 20–35, all were found to be broken from the contact substrate portion, and it can be understood that the strength of the solder bonded portion is improved to great extent as compared with the prior art example.

The effect as described above is not limited to the case of the material of the contact substrate of the Cu-Cr type alloy, but the same is the case also with those containing active metals such as Cr, Ti, Al, etc., and the effect will appear conspicuously as its content is larger, for example 20% by weight or more. Even in the case when containing no active metal such as Cr, Ti, Al, etc., when contamination with oxide coating is considered before assembling of the vacuum interrupter, the process of the present invention is effective regardless of the constituent components of the contact substrate.

Figure 5:
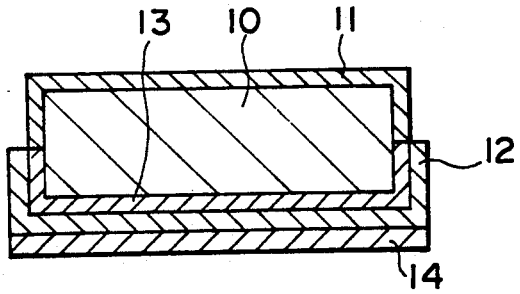
FIG. 5 is a longitudinal sectional view showing another example of the present invention.
Figure 6:
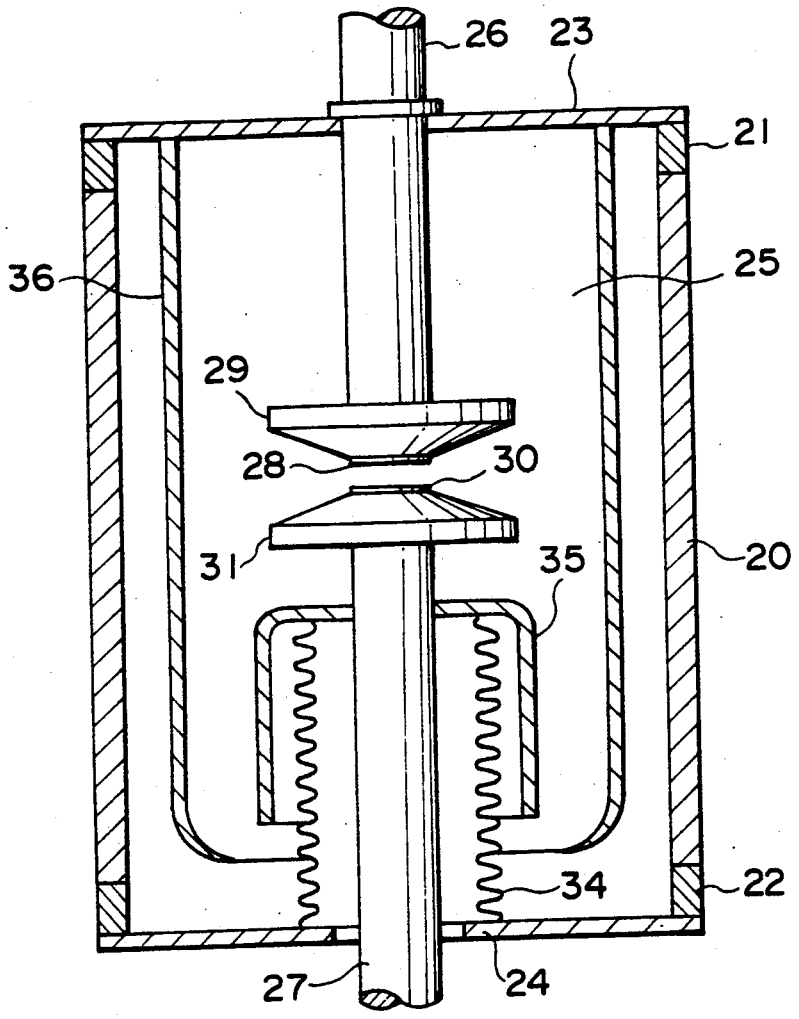
FIG. 6 is a longitudinal sectional view showing the vacuum interrupter contact of the prior art.
Figure 7:
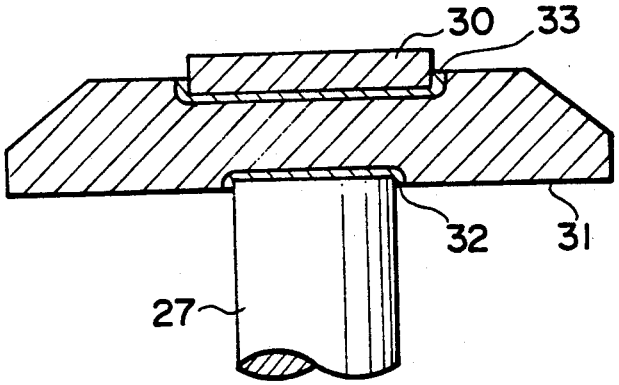
FIG. 7 is a longitudinal sectional view of the electrode portion of the vacuum interrupter shown in FIG. 6.

Also, as shown in FIG. 5, it is possible to form previously Cu or Ag based soldering material 14 for bonding according to the ion plating method on the contact substrate 10 before soldering bonding. As the method for forming the metal coated layer, the barrier layer, the soldering material, etc., corresponding to the bonding strength required, in addition to the ion plating method, other thin film forming techniques can be also practiced in combination.

Further, formation of a large number of suitable coated layers corresponding to the purpose and use is evidently effective, provided that the spirit of the present invention is not altered. Further, with a thickness of the bonded surface side metal coated layer, the barrier layer less than 1 μm has no sufficient effect of preventing the surface oxidation, while a thickness over 10 μm is not industrially feasible because too much time is required for forming the coated layer, even if the effect of the present invention may be obtained.

As described above, according to the present Examples, it is possible to obtain a vacuum interrupter contact of high reliability having no site with a large contact resistance as 100 μΩ, with little variance in contact resistance value, and further with the average value of contact resistance value being limited to 50 μΩ or lower. Also, not only improvement of stability of contact resistance but also welding withdrawing force can be maintained small, and further the bonding strength at the soldering bonding portion can be improved.

As can be evidently seen from the above description, according to the present invention, there can be obtained a vacuum interrupter contact of high reliability with little contact resistance, also with little variance in contact resistance value, capable of maintaining the welding withdrawing force small, and yet having great bonding strength at the soldering portion.

What is claimed is:

1. A vacuum breaker contact having a metal coated layer comprising at least one metal selected from the group consisting of Cu, Ag, Ni, Sn, In, Fe and alloys thereof, said metal coated layer having a thickness of 10 μm or less and having a part of said layer diffused into at least a part of a surface of a breaker contact substrate having a predetermined shape.

2. A vacuum breaker contact according to claim 1, wherein said metal coated layer has a thickness of 5 μm or less.

3. A vacuum breaker contact according to claim 1, wherein said metal coated layer is formed on a surface on a side where an opposed breaker contact of said contact substrate is in contact.

4. A vacuum breaker contact according to claim 1, wherein said metal coated layer is formed on a surface on a side of said contact substrate to be soldered.

5. A vacuum breaker contact according to claim 1, wherein said metal coated layer if formed by an ion plating method.

6. A vacuum breaker contact according to claim 1. wherein a depth of diffusion of said metal coated layer into said contact substrate reaches at least 20% of the thickness of said metal coated layer before diffusion.

7. A vacuum breaker contact according to claim 1, wherein a barrier layer comprising Fe and/or Ni is formed between said substrate and said metal coated layer.

8. A vacuum breaker contact according to claim 1, wherein metal coated layers are formed on both of a surface on a side where an opposed contact of said contact substrate is in contact and a surface on a side to be soldered.

9. A vacuum breaker equipped with said contact according to claim 1.

10. A vacuum breaker contact according to claim 1, wherein said contact substrate comprises an alloy containing 20 to 80% by weight of at least one of Al, Ti and Cr with the balance comprising Cu and/or Ag.

11. A process for producing a vacuum breaker contact, comprising a coating step for forming a metal coated layer comprising at least one metal selected from the group consisting of Cu, Ag, Ni, Sn, In and Fe or an alloy thereof on at least a part of a contact substrate having a predetermined shape to a thickness of 10 μm or less, and a diffusion step for causing a part of said metal coated layer to be diffused into said contact substrate.

12. A processing according to claim 11, wherein said diffusion step is carried out so that a thickness of said metal coated layer at an undiffused portion existing on said surface of said contact substrate may be within the range of from 0 to 5 μm.

13. A process according to claim 11, wherein said coating step is performed according to an ion plating method.

14. A process according to claim 11, wherein said diffusion step is carried out by heating at a temperature of at least 400° C.

15. A process according to claim 11, further comprising a step of forming a barrier layer comprising Fe and/or Ni on said surface of said substrate prior to said coating step.

16. A process according to claim 11, further comprising a step of applying a conditioning treatment on a surface of said metal coated layer.

17. A process according to claim 11, wherein heating in said diffusion step is carried out simultaneously during heating for soldering for said contact.

18. A process according to claim 15, further comprising a step of bonding Cu and/or Ag based soldering material on a surface of said metal coated layer.

19. A process according to claim 18, wherein a layer of said soldering material is formed according to an ion plating method.

20. A process according to claim 11, wherein said contact substrate comprises an alloy containing 20 to 80% by weight of at least one kind of Al, Ti and Cr with the balance comprising Cu and/or Ag.

* * * * *